US006902081B2

(12) United States Patent
Walker

(10) Patent No.: US 6,902,081 B2
(45) Date of Patent: Jun. 7, 2005

(54) GARBAGE CAN LID SECURING SYSTEM

(76) Inventor: Warren Thomas Walker, 379 Dundas St. East, Toronto, Ontario (CA), M5A 2A6

( * ) Notice: Subject to any disclaimer, the term of this patent is extended or adjusted under 35 U.S.C. 154(b) by 33 days.

(21) Appl. No.: 10/674,413

(22) Filed: Oct. 1, 2003

(65) Prior Publication Data

US 2004/0065666 A1 Apr. 8, 2004

(30) Foreign Application Priority Data

Oct. 2, 2002 (CA) ..... 2406301

(51) Int. Cl.[7] ..... B65D 45/00
(52) U.S. Cl. ..... 220/315; 220/908
(58) Field of Search ..... 220/315, 314, 220/318, 324, 908, 908.1, 908.3

(56) References Cited

U.S. PATENT DOCUMENTS

| | | | | | |
|---|---|---|---|---|---|
| 2,636,639 | A | * | 4/1953 | Frey | 220/318 |
| 3,363,924 | A | * | 1/1968 | Remig | 292/258 |
| 3,817,563 | A | * | 6/1974 | McGlothlin | 292/254 |
| 3,893,725 | A | | 7/1975 | Coulter et al. | |
| 3,980,202 | A | | 9/1976 | Monyak et al. | |
| 4,150,464 | A | | 4/1979 | Tracy | |
| 4,241,846 | A | * | 12/1980 | Murphy | 220/318 |
| 4,413,851 | A | | 11/1983 | Ritter | |
| 4,545,501 | A | * | 10/1985 | DeFord | 220/318 |
| 4,819,827 | A | * | 4/1989 | DiSesa | 220/318 |
| 5,078,295 | A | * | 1/1992 | Grant | 220/318 |
| 5,144,725 | A | | 9/1992 | Krauss | |
| 5,255,765 | A | * | 10/1993 | Schrecongost | 190/26 |
| 5,297,692 | A | | 3/1994 | Kronmiller | |
| 5,438,737 | A | | 8/1995 | Anscher | |
| 5,991,985 | A | | 11/1999 | Galbreath | |
| 6,041,960 | A | | 3/2000 | Leal | |
| 6,062,412 | A | * | 5/2000 | Jacobsmeyer, Jr. | 220/259.5 |
| 6,230,920 | B1 | | 5/2001 | Porter | |
| 6,390,522 | B1 | | 5/2002 | Rucker | |
| 2003/0042264 | A1 | * | 3/2003 | Stanwix et al. | |

* cited by examiner

*Primary Examiner*—Lien M. Ngo
(74) *Attorney, Agent, or Firm*—Riches, McKenzie & Herbert LLP

(57) ABSTRACT

A garbage can lid securing system to secure a garbage can lid against removal by animals such as raccoons, the garbage can assembly comprising: a garbage can having a bottom wall, a side wall extending upwardly from said bottom wall and an open top, a lid having a top wall and a side wall extending downwardly from the top wall, the side wall being in removable telescoped engagement over portions of said side wall with garbage can in proximity to the open top, to close the garbage can, a first snap lock mechanism provided on a first side of the lid and can and a second snap lock mechanism provided on a second side of the lid and can, each snap lock mechanism comprising a male snap buckle and a female snap buckle adapted to engage each other in a telescoping snap fit relationship and for release by manual squeezing of one of the male and female snap buckles, one of the male and female snap buckle of each snap lock mechanism coupled to the can and the other of the male and female snap buckle of each snap lock mechanism coupled to the lid.

9 Claims, 4 Drawing Sheets

GARBAGE CAN LID SECURING SYSTEM

SCOPE OF THE INVENTION

An apparatus for securing a garbage can lid against removal as by raccoons.

BACKGROUND OF THE INVENTION

It is a well known problem that animals, such as raccoons, are adept at opening garbage cans as by removing the lids of the garbage cans even when such lids may be closed by latching handles.

It has been known to provide an elastic "bungee" cord across the top of a garbage can to hook onto the handles of garbage cans and to draw the handles to a latched orientation as, for example, in some cases to draw the handles together across the top of the lid. Such elastic cords have the disadvantage that they are dangerous to open and provide a hazard to persons, particularly garbage men, to empty the trash containers. On removal of the elastic cords, the elastic cords can snap back into position with their hooks to engage or catch a garbage man's hands, arm, fingers or face. As well, the length of the elastic cords provides a hazard which can be caught on a person handling the garbage can or its lid.

Previously known systems for securing garbage cans suffer the disadvantage that they are either difficult to use or provide hazards in use as to garage men and others.

SUMMARY OF THE INVENTION

To at least partially overcome these disadvantages of previously know devices, the present invention utilizes side release snap buckles to removably secure a garbage can lid to the garbage can. This securing system preferably incorporates an elongate strap which extends across a garbage can and carries a pair of side release snap buckles at either end adapted to engage complementary snap buckles on the sides of the garbage can. If a garbage can lid has handles, the snap buckles on the can can be secured to the handles. The strap is preferably non-elastic and secured to the lid. Each snap buckle may readily be released by one hand of a user. The snap buckles, whether tethered to the lid or the garbage can, are tethered by relatively short connecting straps such that they do not present a hazard as an elongate appendage. Preferably, tensioning means are provided to permit tensioning of each of the snap buckles, however, without the use of elastic members.

An object of the present invention is to provide a garbage can lid securing system to secure a garbage can lid against removal by animals such as raccoons.

Another object is to provide an improved garbage can including a securing system in accordance with the present invention.

Another object is to provide a kit for retrofitting a garbage can so as to apply a securing system.

In one aspect, the present invention provides a garbage can assembly comprising:

a garbage can having a bottom wall, a side wall extending upwardly from said bottom wall and an open top, a lid having a top wall and a side wall extending downwardly from the top wall, the side wall being in removable telescoped engagement over portions of said side wall with garbage can in proximity to the open top, to close the garbage can, a first snap lock mechanism provided on a first side of the lid and can and a second snap lock mechanism provided on a second side of the lid and can, each snap lock mechanism comprising a male snap buckle and a female snap buckle adapted to engage each other in a telescoping snap fit relationship and for release by manual squeezing of one of the male and female snap buckles, one of the male and female snap buckle of each snap lock mechanism coupled to the can and the other of the male and female snap buckle of each snap lock mechanism coupled to the lid.

Further aspects and advantages of the present invention will become apparent from the following description taken together with the accompanying drawings.

DETAILED DESCRIPTION OF THE DRAWINGS

Figure 1:
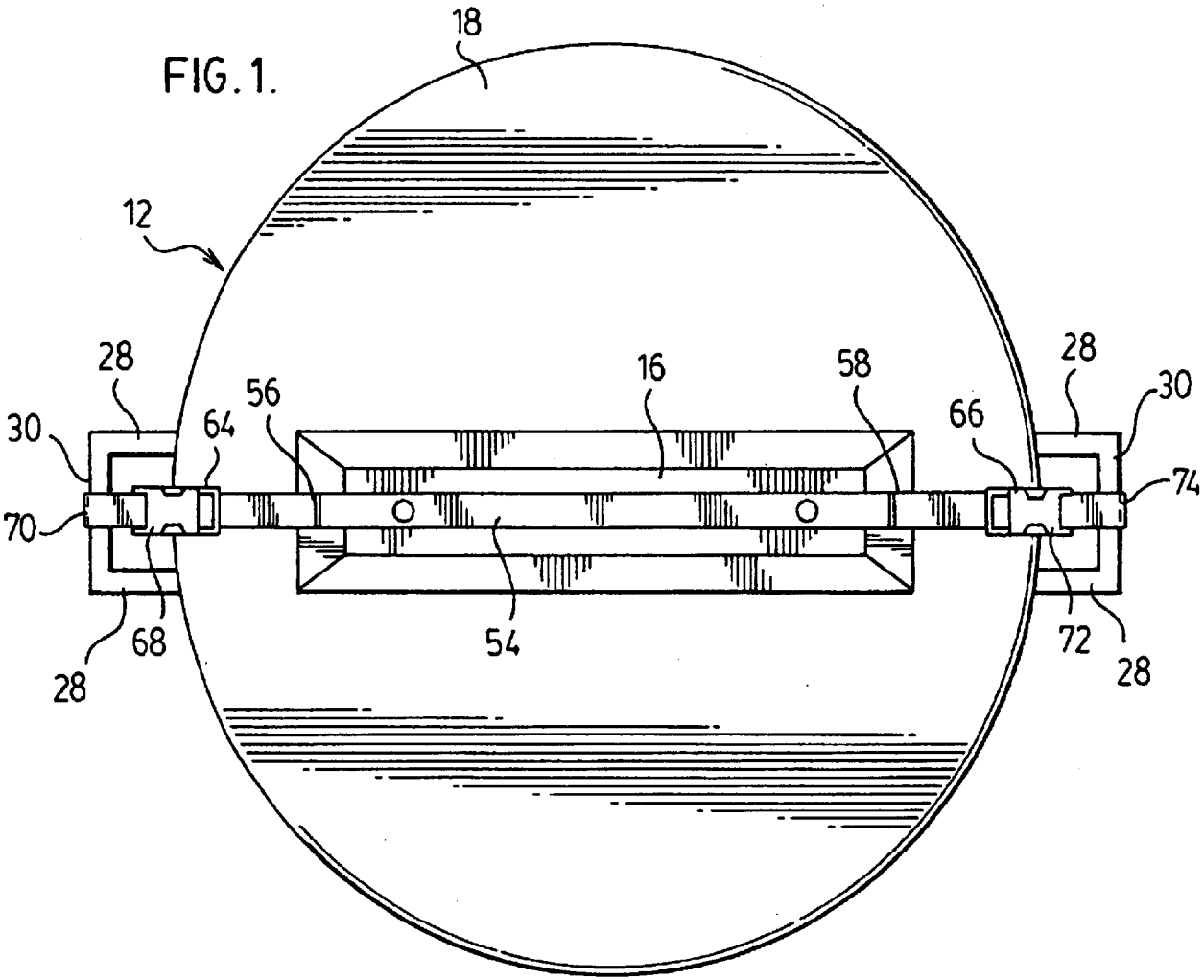
FIG. 1 is a top view of a garbage can with a lid securing system in accordance with a first embodiment of the present invention.
Figure 2:
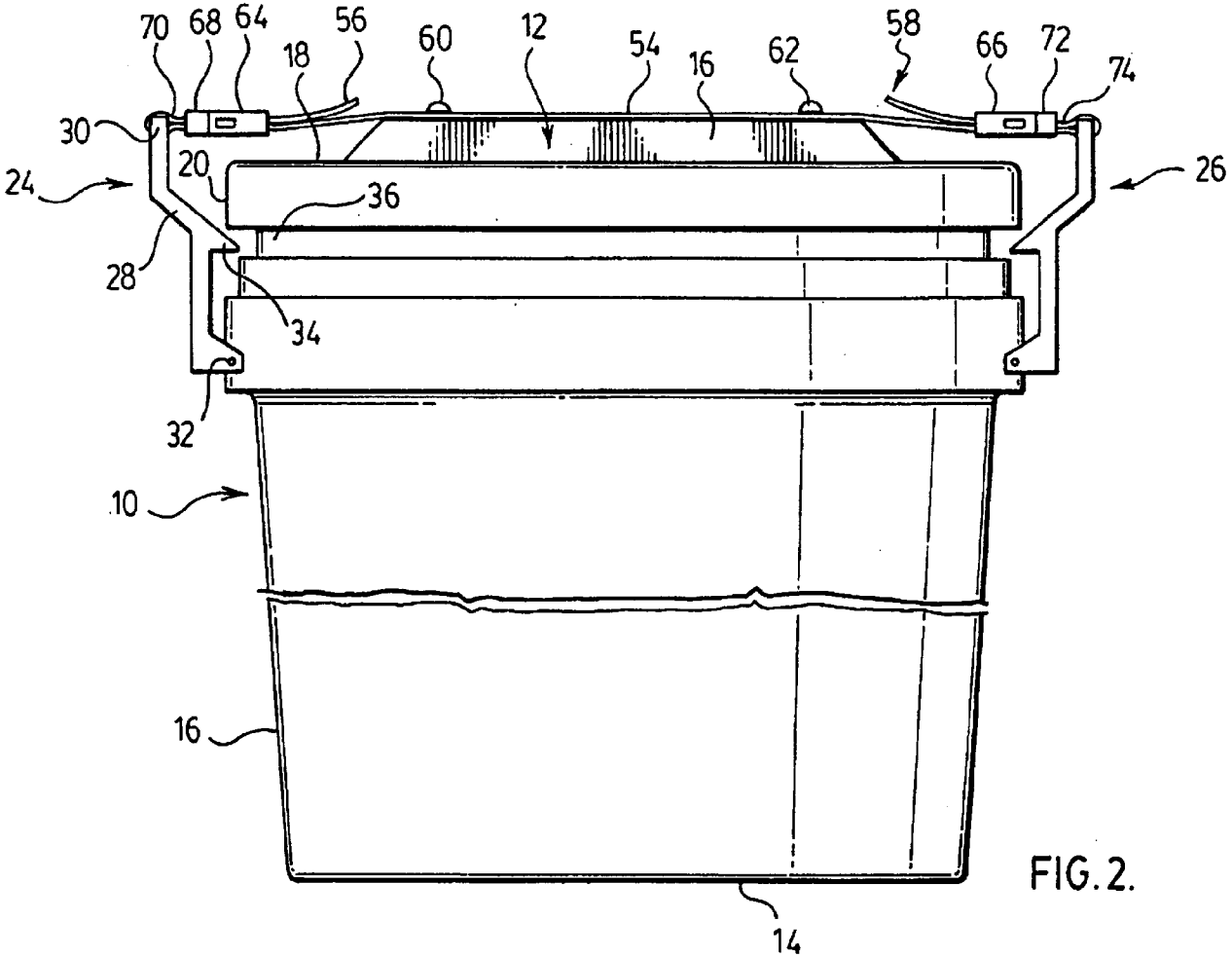
FIG. 2 is a side view of the garbage can of FIG. 1.

Reference is made first to FIGS. 1 and 2 which show a typical refuse container comprising a garbage can 10 and a lid 12. The can has a bottom wall 14 and upstanding side walls 16.

The can 10 is closed by the lid. The lid 12 has a top wall 18 and downwardly extending side walls 20. In a known manner, the side walls 16 of the can 10 are received telescopically inside the side walls 20 of the lid 12 such that lid closes the can 10.

In the particular embodiments shown, the lid 12 includes a raised center ridge 16 which can assist in providing structural reinforcement to the lid 12.

Two handles 24 and 26 are shown coupled to the can 12. Each handle is shown as having a pair of handle side arms 28 bridged by a handlebar 30. The handle side arms 28 are pivotally connected to the side wall 16 of the can for pivoting about handle pivot axis 32.

Each handle side arm 28 carry a handle catch 34. The lid 12 carries an annular groove 36 in its side wall 20. The handles 24 and 26 are adapted to be secured in a position in which the handle catches 34 engage within an annular groove 36 in the side wall 20 of the lid to lock the lid 12 onto the can 10 against removal.

As seen in FIGS. 1 and 2, two snap lock mechanisms are provided to lock the handles 24 and 26 in their locked position against movement. Each lock mechanism comprises a snap buckle as illustrated in exploded view in FIG. 5. Such snap buckles are well known as taught, for example, in U.S. Pat. No. 5,991,985 to Galbreath, issued Nov. 30, 1999, U.S. Pat. No. 4,150,464 to Tracy, issued Apr. 24, 1979 and U.S. Pat. No. 5,438,737 to Anscher et al, issued Aug. 8, 1995, each of which is incorporated herein by reference.

The snap buckle 40 comprises a male snap buckle or plug 42 having side catch arms 44 and a female snap buckle 46 has a socket 45 adapted to receive the forwardmost portions of the male snap buckle 42 in a telescoping manner until the side catch arms 44 engage on catch surfaces 47 in a socket formed within the female snap buckle 46. To disengage the male snap buckle 42 from the socket of the female snap buckle 46, the side catch arms 44 on the male snap buckle are manually depressed to disengage them from the catch surfaces 42 in the female socket. To accommodate this, the female snap buckle 46 has openings 49 in its side edges which permit, when the male snap buckle is received within the female snap buckle, for a person to manually engage the side catch arms 44 and depress them inwardly.

Figure 5:
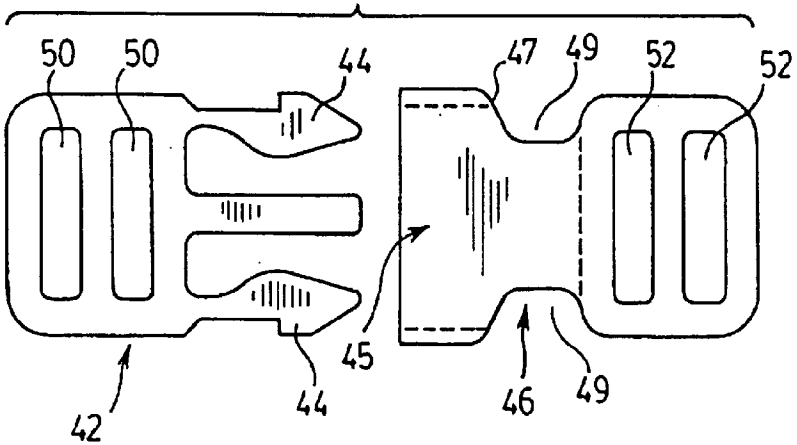
FIG. 5 is an exploded view of a side release buckle as shown in FIG. 1.

As seen in FIG. 5, the male element has a first end carrying the side catch arms 44 and a second end carrying strap receiving openings 50. In a known manner, a strap of flexible material is adapted to be passed through the openings 50 to secure the male snap buckle to a strap. Similarly, the female snap buckle has a first end carrying its female socket 45 and a second end carrying openings 52 to receive a retaining strap in a known manner.

Referring to FIGS. 1 and 2, an elongate restraining strap 54 having a first end 56 and a second end 58 is shown as extending along the top ridge 16 and secured to the lid 12 by two fastening devices 60 and 62 each being disposed proximate to each of the side walls 20 of the lid with a view to minimizing the free length of the strap 54 from each fastener to a respective free end of the strap. The first end 56 of the strap 54 is secured to a first female buckle member 64 and the second end 58 of the strap 54 is secured to a second female buckle member 66. A first male buckle member 68 is secured to the handlebar 30 of the first handle 24 by reason of a length of strap 70 which loops about the handlebar 30 and has both free ends of the strap secured to the male buckle member 68. Similarly, a second male buckle member 72 is secured to the second handle 26 by reason of a length of strap 74 being looped around the handlebar 30 and having both its ends secured to the second male buckle member 72. As seen in FIG. 2 in side view, with the male and female buckle members coupled together, the free ends 56 and 58 of the retaining strap 54 are accessible to be manually engaged and to draw any excess strap through the loops of female buckle members and to tension at the snap buckle members so as to draw the handles inwardly to a locked position.

In any locked position, it is to be appreciated that by a person manually engaging the snap buckle members, that the snap buckle members may be released and the handles moved to an open position. Once the relative length of the retaining strap 54 between the snap buckle members has been set to lock the handles against opening, it is merely a simple matter to insert the respective male buckle member into the female buckle member to couple the snap buckle members together.

Figure 3:
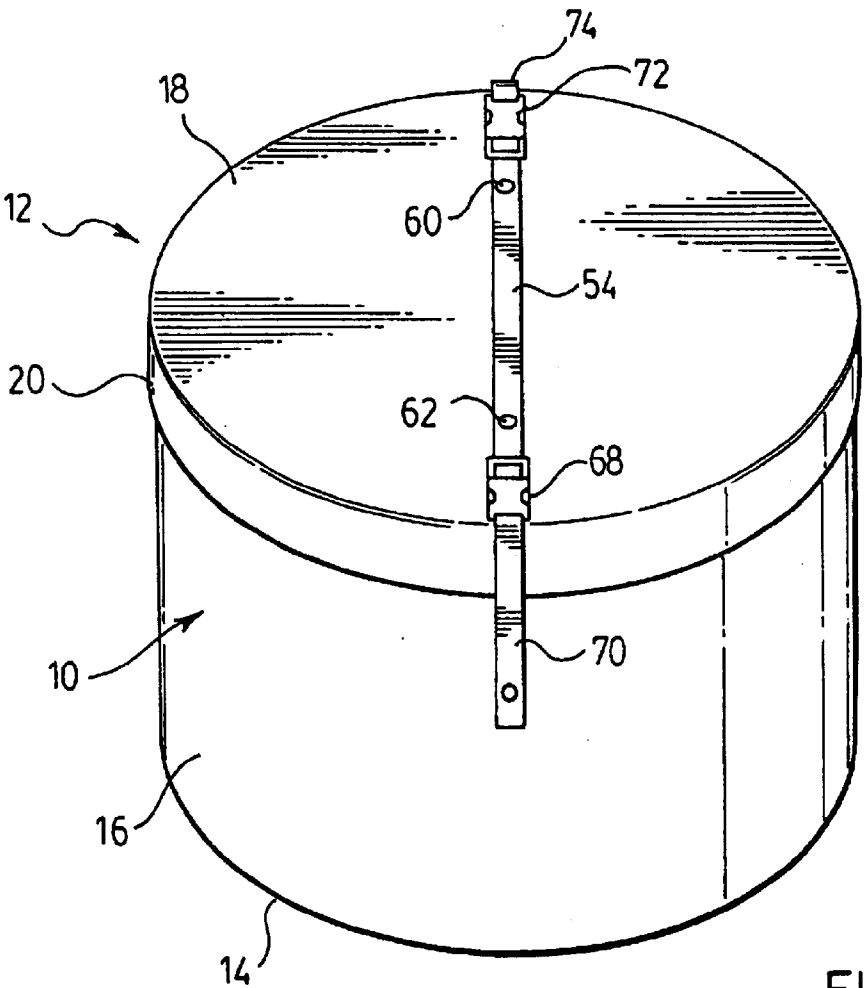
FIG. 3 is a pictorial view of a garbage can of the lid securing system in accordance with a second embodiment of the present invention.
Figure 4:
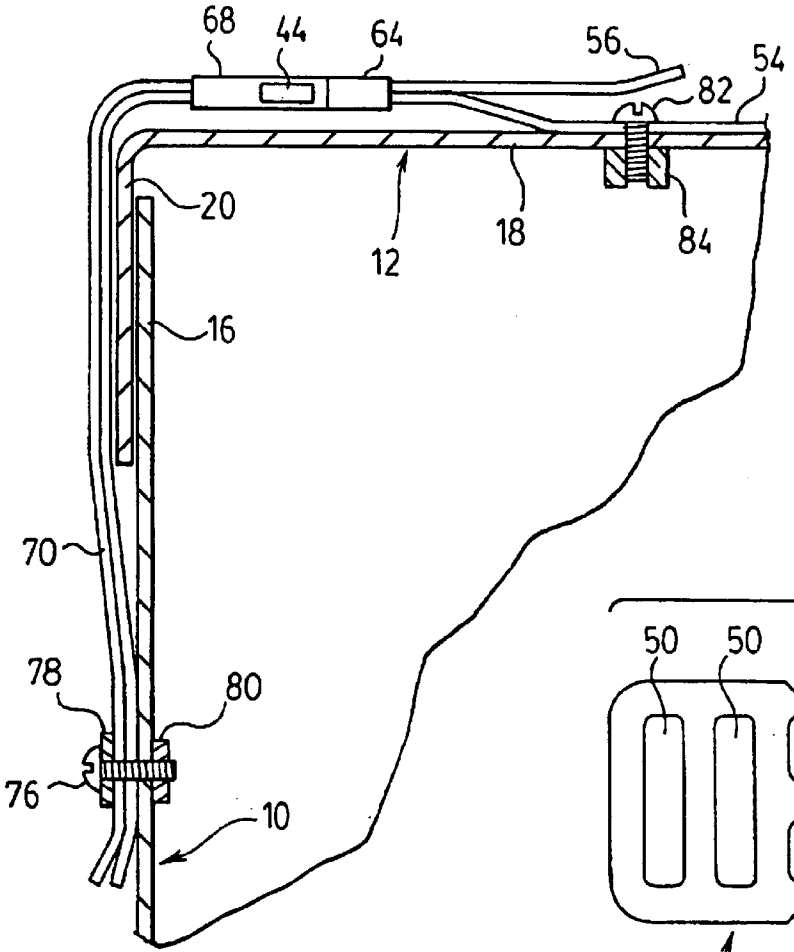
FIG. 4 is a schematic side view of the garbage can shown in FIG. 3.

Reference is made to FIGS. 3 and 4 which illustrate a simplified form of a second type of refuse container in which similar elements are used to refer to similar parts. The container of FIGS. 3 and 4, however, does not have lock handles. Rather, the female buckle members 68 and 72 are shown as being attached directly to the side wall 16 of the can 10 by securing tethering straps 70 and 74 for the male buckle member to the side wall 16 of the can.

It is to be appreciated that in the embodiment illustrated in FIG. 1, while the snap buckles are shown as being attached to the handles, it can readily be appreciated that the male buckle members could alternatively have been attached to the side wall of the can 10 as by straps 70 and 74 in FIG. 1 such that the snap buckle members could be independent of the handles.

FIG. 4 shows two different fastener configurations. On the side wall 16 of the can 10, the fastener comprises a threaded nut 76 which passes through a washer 78 and is received in a nut 80 inside wall 16. The use of a washer is not necessary. On the top wall 18 of the lid 12, a fastener is shown with a bolt 82 received in a preferred lock nut 84 with a rounded edge. In FIG. 4, the fastener 76 securing to the side wall 16 is shown as engaging two layers of strap 70 such that the strap would pass upwardly as a loop through the female buckle member 68 without providing length adjustment. This is an alternate arrangement and less preferred than having the strap received in the buckle member to accommodate length adjustment. In FIG. 5, it is shown that the strap is secured to the lid with fastener 82 passing through merely over one layer of the strap so that the free end 56 of the strap is available for varying length.

Particular fasteners illustrated are shown as threaded fasteners which can easily be provided in a kit for retrofitting of garbage cans which have previously been purchased. For assembly, it is merely required to form a hole in the can or lid in appropriate locations and to secure the retaining strap thereto by the fasteners. Various other fastener systems may be provided including rivets, adhesives, Velcro straps and the like. As well, it would be possible to provide a pair of spaced slots in the lid or in the side wall of the can and to have the strap looped through the same for connection.

Both embodiments show the retaining strap 54 secured to the lid 12 is a continuous piece with two ends, one end of which is secured to a snap buckle members on one side of the lid and the other end of which is secured to a snap buckle member on the other side of the lid. This is believed to be advantageous, in the context of when a person or animal may attempt to force open the handles, the stresses which may be developed are ultimately transferred through the retaining strap from one snap buckle member on one side to the other snap buckle member on the other side.

The retaining straps preferably do not extend an undue length from their securement on the can or lid to their respective snap buckle member, preferably no greater than six inches or about 15 cm.

In the preferred embodiments, the snap buckle assemblies will be visible from the top of the garbage can which assists a user seeing the two snap buckle members that are to be grasped for uncoupling. Preferably, the entirety of a snap buckle assembly is disposed on top of the lid so that the snap bundle assembly is not tensioned about the edge of the lid as might give rise to the strap slipping from engagement with the buckle member.

The straps preferably comprise a flexible elongate material which is not elastic. Preferred such materials comprise a woven strap of material such as are well known for coupling snap lock buckles. Such strapping may comprise, for example, woven webbing of synthetic materials such as Nylon, polypropylene and the like and is commercially available in various widths.

In one aspect, the present invention provides a kit which can be sold and used to retrofit existing garbage cans to adopt the systems in accordance with the present invention. In this regard, a typical kit would include a pair of snap buckle assemblies, a suitable length of strap material and suitable fasteners. A preferred kit may comprise two snap buckle assemblies and three lengths of straps as well as four fasteners with each fastener preferably comprising a threaded bolt and a nut as well as possibly one or more washers.

While the particular size of the buckles and strap is not significant, preferred buckles and straps are those adapted for use on about one inch wide strap in order to provide a compromise between ease of engagement by a person's fingers and cost. Preferred snap buckles are those which snap together by mere engagement of a male element in a female element and which can be manually disengaged preferably with one hand as by squeezing.

The invention has been described with reference to preferred embodiments. Many variations and modifications will now occur to persons skilled in the art. For a definition of the invention, reference is made to the following claims.

I claim:

1. A garbage can assembly comprising:

a garbage can having a bottom wall, a side wall extending upwardly from said bottom wall and an open top, a lid having a top wall and a side wall extending downwardly from the top wall, the side wall being in removable telescoped engagement over portions of said side wall with garbage can in proximity to the open top, to close the garbage can, a first snap lock mechanism provided on a first side of the lid and can and a second snap lock mechanism provided on a second side of the lid and can, each snap lock mechanism comprising a male snap buckle and a female snap buckle adapted to engage each other in a telescoping snap fit relationship and for release by manual squeezing of one of the male and female snap buckles, one of the male and female snap buckle of each snap lock mechanism coupled to the can and the other of the male and female snap buckle of each snap lock mechanism coupled to the lid.

2. A garbage can assembly as claimed in claim 1 wherein each of the male and female snap buckles are coupled to their respective can or lid via an elongate tether strap having two ends with a first end of the tether strap secured to its respective can or lid and a second end of the tether strap secured to one of the male or female snap buckles.

3. A garbage can assembly as claimed in claim 1 including a single tether strap spanning across the top of the lid and having two ends, a first end connected to a male or female snap buckle of the first snap lock mechanism and the second end secured to a male and female snap buckle of the second snap lock mechanism.

4. A garbage can assembly as claimed in claim 3 wherein the tether strap is secured to the lid at two spaced locations, each location being proximate to a side wall of the lid.

5. A garbage can assembly as claimed in claim 2 in which the can includes first and second handles secured at diametrically opposite portions on said side wall in proximity to the open top, wherein the tether straps which are secured to the can are secured via loops to the handles.

6. A garbage can assembly as claimed in claim 5 wherein said first and second handles are pivotally secured at diametrically opposite positions on the side wall.

7. A garbage can assembly as claimed in claim 1 wherein said male or female snap buckles which are secured to the can are secured to the respective handles by tether straps comprising a continuous loop of fixed length.

8. A garbage can assembly as claimed in claim 2 wherein male or female snap buckles which are coupled to the lid have the end of the tethering strap received therein in a looped arrangement whereby the tether strap extends through a locking loop arrangement on the buckle and back towards the lid presenting an open end of the tether strap, such that on a person manually pulling on the open end of the tether strap draws the male or female buckle carried thereon towards a center of the lid, thus tensioning the tensioning strap when the snap lock mechanism is coupled.

9. A garbage can assembly as claimed in claim 2 in which the tethering straps are secured to the lid via threaded fasteners extending through the lid.

* * * * *